United States Patent [19]

Kim

[11] Patent Number: 4,653,299

[45] Date of Patent: Mar. 31, 1987

[54] KEY HOLDER

[76] Inventor: Bonjue Kim, 99B Hinchman Ave., Wayne, N.J. 07470

[21] Appl. No.: 817,127

[22] Filed: Jan. 8, 1986

[51] Int. Cl.[4] ..... A47G 29/10

[52] U.S. Cl. ..... 70/456 R

[58] Field of Search ..... 70/456 R, 456 B, 457–459; 150/40; 24/3 K

[56] References Cited

U.S. PATENT DOCUMENTS

| | | | |
|---|---|---|---|
| 2,402,347 | 6/1946 | Rotheraine | 70/456 R |
| 2,411,168 | 11/1946 | Seely | 70/456 R |
| 2,560,595 | 7/1951 | Poncar | 70/456 R |
| 2,634,600 | 4/1953 | Seely | 70/456 R |
| 2,645,113 | 7/1953 | Olsen | 70/456 R |
| 2,690,666 | 10/1954 | Engel | 70/456 R |
| 2,695,511 | 11/1954 | Wing | 70/456 R |
| 2,853,312 | 12/1958 | Groulx | 70/456 R |
| 3,765,201 | 10/1973 | Humphrey | 70/456 R |
| 3,877,269 | 4/1975 | Dehart | 70/456 R |
| 4,281,527 | 8/1981 | Leopoldi | 70/456 R |

*Primary Examiner*—Robert L. Wolfe

[57] ABSTRACT

A key holder comprises a case, a key tray and a key suspender. A respective key may be selected by moving a slide handle from the outside of the key holder until a respective key identification is found and drawn simply by flipping the key holder.

1 Claim, 4 Drawing Figures

KEY HOLDER

This invention relates to key holding apparatus and more particularly to an improved key holder which completely contains keys in its enclosure and may draw only one respective key at a time by moving a slide handle.

Heretofore, there have been many prior art on key holders which hold keys in their metal case and provide key selection method using extracting keys by hand via predefined selection slots or by pushing dedicated selection buttons for each key. These prior art utilize heavy materials such as metals and too many parts and have very limited capability of carrying out key selections. Moreover, they are incapable of completely enclosing keys in key holders so as to protect user's pockets from being ruined while carrying keys in the pockets.

Therefore, these prior art are heavy in weight, complex in structure, bulky in size and impractical in use.

Sometimes, a speedy draw of a respective key saves human being's lives from crime in dark streets these days. However, these prior art all fail to serve this purpose because they are either incapable of providing a speedy draw or impractical to carry in pocket.

Accordingly, several objects of my invention are to provide:

(a) a unique key identification means by symbols, sounds or feelings so as to identify a key regardless of light or human eye conditions, (b) a speedy draw of a respective key without opening key holder lid or detaching a member from a key holder, (c) a complete enclosure for keys in it without exposing any part of the keys to protect user's pocket from being damaged, and (d) a light weight and compact size to make this invention practical.

Further objects and advantages of my invention will become apparent from a consideration of the drawings and ensuing descriptions thereof.

DRAWINGS

DESCRIPTION

Figure 1:
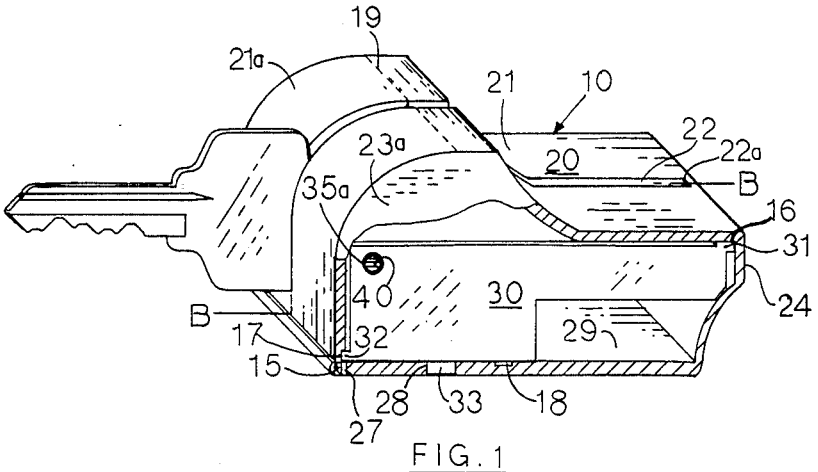
FIG. 1 shows a partially hatched perspective view of an embodiment of a key holder of this invention.
Figure 2:
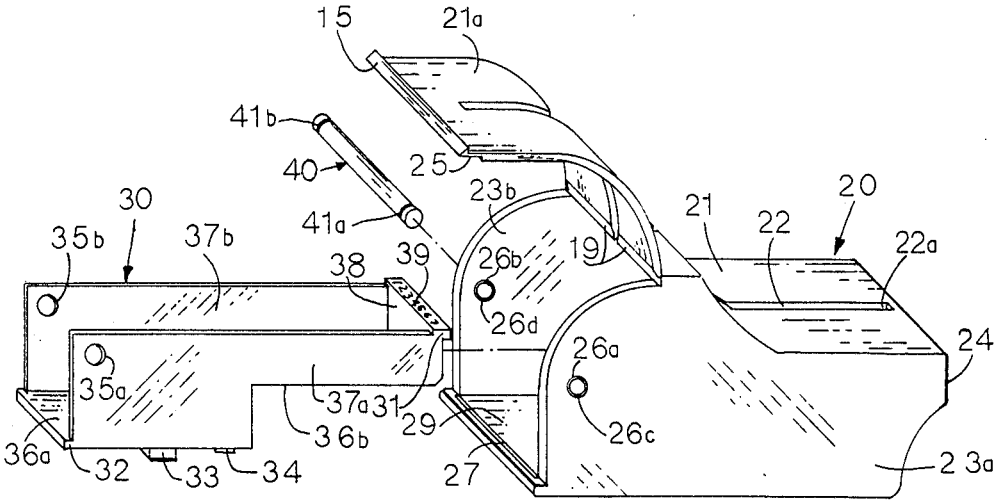
FIG. 2 shows an exploded view of the key holder.
Figure 3:
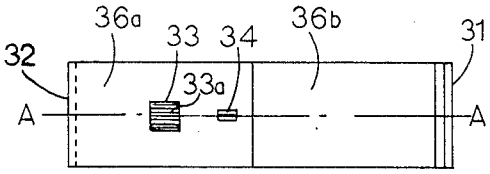
FIG. 3 shows a plan view of the bottom of the key tray.
Figure 4:
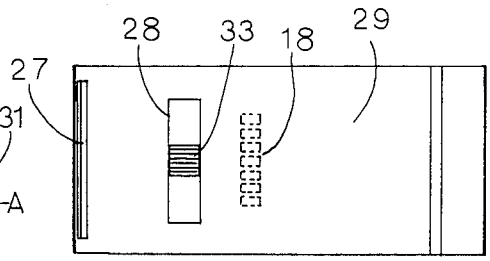
FIG. 4 shows a plan view of the bottom of the key holder.

Refering to the drawings and more particularly FIG 1, it can be seen an improved key holder 10 having a tray 30, which contains keys, a pin 40, which runs through key holes and holds keys in place, and a case 20, which completely encloses keys. The case 20 and the tray 30 are made of nylon or the like to provide a light weight and smoothness with flexiblity, and the pin 40 is made of a metal or the like.

The pin 40 has a smooth surface and grooves 41*a*,41*b* around the pin 40 on its both ends. The ends of the pin 40 are round so that it may make easy on pushing the pin 40 through holes 26*a*,26*b* of the case 20.

The tray 30 is consisted of tray side walls 37*a*,37*b*, an end wall 38 and tray bottoms 36*a*,36*b* and has a profile of a step, which may be defined as a deep section 36*a* and a shallow section 36*b*. The deep section 36*a* of the tray 30 has a depth of slightly deeper than width of one half of key handle to house key handles, and the shallow section 36*b* has a full width of key shank to house key shanks when keys are loaded in the tray 30. The inside width of the tray 30 is slightly wider than combined thickness of a number of keys to be used; that is, the number of keys are seven keys in this example. The tray 30 is further consisted of tray guides 31,32, a slide handle 33, a bump 34, and pin guide holes 35*a*,35*b* on the tray side walls 37*a*,37*b*. The tray guides 31 and 32 are longitudinally protruded from the top of the end wall 38 and 36*a*, respectively. On the top of the tray guide 31, there are key identification numbers 39 or characters, which are envenly spaced at a distance of 3/32 inches along the tray guide 31 and used for identifying. The slide handle 33, which has a generally rectangular shape, is located in the middle of 36*a*, centered along the line A—A and protruded from 36*a* surface. The height of the slide handle 33 is the same as the thickness of the case bottom 29. The surface 33*a* of the slide handle 33 has a coarse finish to provide a frictional resistance when the tray 30 is moved back and forth by finger. The bump 34, which has a shape of a triangular prism with an altitude of less than one-third of the slide handle, is located in front of the slide handle 33 along the line A—A and protruded from the outside surface of the tray bottom 36*a*. The pin guide holes 35*a*, 35*b* have a diameter larger than the pin 40 so that the tray 30 may freely slide along the pin 40.

The case 20 principally has a Jeep-shape contoured one end as shown in FIG. 1 and is consisted of a case top 21, a lid 21*a*, a case bottom 29, side walls 23*a*, 23*b* and an end wall 24. A key slot 22 on the case top 21 runs along the line B—B and has a width slightly wider than the thickness of keys so that only one key may be drawn or inserted through 22. One end of the key slot 22 toward the end wall 24 functions as a window 22*a* to display the key identification numbers 39 or characters, and the other end of the key slot 22 runs through the lid 21*a* along the lines B—B and ends at near the end of lid 21*a*.

The lid 21*a* is a contineous portion of the case top 21 and is consisted of a hinge line 19, an L-shape notch 25 and a latch 15. The hinge line 19 is located inside and across the lid 21*a* on the border line between the case top 21 and the lid 21*a* in parallel with the end wall 24 and is formed by a score of a V-shape so that the lid 21*a* may easily be flexed about the hinge line 19 for closing or opening. The L-shape notch 25 is located inside and at the end of the lid 21*a*. The height and depth of the L-shape notch 25 is slightly higher than the combined thickness of the case bottom 29 and tray guide 32 and less deep than the depth of 32, respectively, so that the tray 30 may be able to laterally move with the lid 21*a* being closed. The latch 15, which is a generally triangular prism shape located across the end of the lid 21*a*, is protruded from the outside of the lid 21*a* and provides a push-in-latch mechanism for closing the lid 21*a*.

The case bottom 29 is consisted of a receptacle 27, which is located at an end toward the lid 21*a*, a cut-out 28, which is a rectangular hole, and seven indentations 18, which have identical shape and dimension to the bump 34, inside of the case bottom 29. The receptacle 27 is constructed such a way to receive and retain the latch 15 by depressing the lid 21*a* into 27. The cut-out 28 is made symmetrically about the line B—B to provide an opening for accessing the slide handle 33 so that the tray 30 may be moved back and forth by pushing slide handle 33 back and forth from outside of the case 20. The indentations 18 are evenly spaced at a distance of 3/32 inches, which is equivalent to the thickness of keys, and symmetrically arranged about the line B—B to give both side the same indentation numbers. The bump 34 and one of the indentations 18 are subject to mate together, and the shape and dimension of the indentations 18 are, therefore, identical to the bump 34 of the tray 30. Each side wall 23*a*,23*b* has a pin retaining hole 26*a*, 26*b*, which has the same diameter as the diameter of the pin 40, to retain the pin 40. The pin retaining holes 26*a*, 26*b* are located near by the lid 21*a* and have to be aligned with the pin guide holes 35*a*, 35*b* of the tray 30. The pin retaining holes 26*a*, 26*b* have thin lips 26*c*, 26*d* inside of the wall 23*a*, 23*b*, which is flexible and have the same diameter as the diameter of the grooves 41*a*, 41*b* to latch the pin 40 on it via the grooves 41*a*, 41*b*.

To load keys in the key holder 10, open the lid 21*a* by unlatching the latch 15, remove the pin 40 by pushing out of the pin retaining holes 26*a*, 26*b* and the pin guide holes 35*a*, 35*b*, arrange the keys in order of preferred identification numbers or characters, place keys in the tray 30, push back in the pin 40 through 26*a*, 26*b*,35*a*,35*b* such a way to run through all the key holes and close the lid 21*a*.

The tray 30 is retained inside of the case by a slot 17 (formed by the L-shape notch and the case bottom 29) and a corner 16 (formed by the case top 21 and the end wall 24) via the guides 32,31. The tray 30 may be moved back and forth along the slot 17 and the corner 16 by pushing the slide handle 33 back and forth with finger, and a key identification number is positioned when the bump 34 and one of the indentations 18 are mated together. Since the tray 30 provides a certain spring tension when the bump 34 moves between the indentations, mating action between the bump 34 and one of the indentations 18 creats a click sound or an equivalent vibration. A desired key may be selected by moving the slide handle 33 until a desired key identification number appears at the window 22*a* or by counting a desired number of the click sound or vibration caused by clicking while moving slide handle 33, and then the desired key may be drawn by flipping the key holder 10.

While the above description contains many specifities, these should not be construded as limitations on the scope of the invention, but rather as an examplification of one preferred embodiment thereof. Many other variations are possible; for example, a sounding means may be adapted so that every key has a uniquely identifiable sound, or a rotary knob may be adapted in place of the slide handle 33 to move the tray 30 back and forth with rotary action.

Accordingly, the scope of the invention should be determined not by the embodiment illustrated, but by the appended claims and their legal equivalents.

What is claimed is:

1. A key holder comprising:

a. a case having a slot for drawing a key therefrom, a means for identifying keys, a lid for accessing inside of said case, a hole for moving a tray therein, a means for registering key position, and a key suspender;

b. said tray for holding at least one key therein having a guide for guiding said tray movement inside of said case, a means for causing said tray to move along said guide thereof, a means for latching a respective key position on said means for registering key position via said tray, and a means for providing key identification; and c. said key suspender for suspending keys via key holes.

* * * * *